US007030719B2

(12) United States Patent
Hageman et al.

(10) Patent No.: US 7,030,719 B2
(45) Date of Patent: Apr. 18, 2006

(54) METHOD FOR TUNING THE CENTER FREQUENCY OF EMBEDDED MICROWAVE FILTERS

(75) Inventors: Michael A. Hageman, Millersville, MD (US); Cynthia W. Berry, Pasadena, MD (US)

(73) Assignee: Northrop Grumman Corporation, Los Angeles, CA (US)

( * ) Notice: Subject to any disclaimer, the term of this patent is extended or adjusted under 35 U.S.C. 154(b) by 151 days.

(21) Appl. No.: 10/758,095

(22) Filed: Jan. 16, 2004

(65) Prior Publication Data

US 2005/0156689 A1 Jul. 21, 2005

(51) Int. Cl.
*H01P 1/20* (2006.01)

(52) U.S. Cl. ..... 333/202; 333/209

(58) Field of Classification Search ..... 333/202, 333/209, 205, 235; 156/89.11, 89.12; 264/614, 264/662

See application file for complete search history.

(56) References Cited

U.S. PATENT DOCUMENTS

| | | | | |
|---|---|---|---|---|
| 5,150,088 | A | 9/1992 | Virga et al. | |
| 5,219,377 | A | 6/1993 | Poradish | |
| 5,382,931 | A | 1/1995 | Piloto et al. | |
| 6,137,383 | A | 10/2000 | De Lillo | |
| 6,483,404 | B1 * | 11/2002 | Ammar et al. | 333/204 |
| 6,535,083 | B1 | 3/2003 | Hageman et al. | |

OTHER PUBLICATIONS

Low Temperature Cofired Ceramic (LTCC) Ridge Waveguide Bandpass Filters, Yu Rong et al., University of Maryland, Electrical Engineering Dept., College Park, MD 20742, USA, pp. 1147-1150.

LTCC Wide-Band Ridge-Waveguide, Yu Rong, IEEE Transactions on Microwave Theory and Techniques, vol. 47, No. 9, Sep., 1999, pp. 1836-1840.

A Novel Coplanar Transmission Line to Rectangular Waveguide Transition, W. Simon et al., 1998 IEEE MTT-S Digest, pp. 257-260.

Development of a "Laminated Waveguide", Hiroshi Uchimura et al., IEEE Transactions On Microwave Theory and Techniques, vol. 46, No. 12, Dec., 1998, pp. 2438-2443.

Embedded Waveguide Filters for Microwave and Wireless Applications using Cofired Ceramic Technologies, J. Gipprich, et al., 1998 International Symposium on Microelectronics, pp. 1-4.

* cited by examiner

*Primary Examiner*—Seungsook Ham
(74) *Attorney, Agent, or Firm*—Birch, Stewart, Kolasch & Birch, LLP

(57) ABSTRACT

A method of tuning the frequency response of filters embedded in or formed on a ceramic substrate, such as but not limited to a low temperature co-fired ceramic substrate (LTCC), by re-firing a previously fired LTCC substrate to a temperature which is greater by a predetermined, relatively small, amount than that of the temperature produced during the original firing profile of the substrate so as to change the dielectric constant of the substrate, and thus cause a desired shift in the filter's frequency response.

12 Claims, 5 Drawing Sheets

METHOD FOR TUNING THE CENTER FREQUENCY OF EMBEDDED MICROWAVE FILTERS

FIELD OF THE INVENTION

This invention relates generally to microwave filters embedded in a co-fired ceramic substrate, and more particularly to a method of tuning the center frequency of filters embedded in a low temperature co-fired ceramic (LTCC) substrate.

DESCRIPTION OF RELATED ART

The center frequency of a filter embedded in co-fired LTCC is known to vary depending upon the dielectric constant of the fired substrate. FIG. 1 depicts three sets of simulated characteristic curves which correspond to the expected response of a filter embedded in an LTCC substrate and whose dielectric constant $\in_r$ is varied over the range 5.85 to 6.15. As is well known, the center frequency $F_0$ is inversely proportional to the square root of the dielectric constant $\in_r$, i.e., $F_0=1/\sqrt{\in_r}$. In FIG. 1 two sets of characteristic curves S21 and S11 are shown for three values of dielectric constant, i.e., where $\in_{r1}=5.85$, $\in_{r2}=6.0$ and $\in_{r3}=6.15$. The three curves labeled S21 (input at port 1, output at port 2) depict a measure of filter insertion loss vs. frequency while the second set of curves S11 (input at port 1, reflected signal at port 1) depicts the amount of signal reflected back to the input port for each frequency and thus is a measure of return loss.

In each instance it can be seen that the center frequency $F_o$ is higher for a dielectric constant of $\in_{r1}=5.85$, relatively lower at $\in_{r2}=6.0$, and lowest at $\in_{r3}=6.15$. Thus it can be seen in FIG. 1 that with all other parameters unchanged, for a filter designed with a center frequency $F_o=10$ GHz, varying the dielectric over the range $\in_r=6.0\pm0.15$ produces a variation in center frequency of ±1.3%. For a center frequency $F_o$ of 10 GHz as shown in FIG. 1, a shift of ±130 MHz would be expected in all filters embedded in an LTCC substrate.

It should be noted that 1.3% variation in center frequency as shown in FIG. 1 is greater than that seen in typical combline tuned filter(s) obtained, for example, from a filter manufacturer. Accordingly, the cost of carefully tuned filters is higher due to the labor required to perform the tuning. Furthermore, the relatively large variation in center frequency in LTCC embedded filters currently limits their usage to applications which do not require precise control of the center frequency.

The dielectric constant of LTCC green tape cannot be accurately controlled by the manufacturers of the tape, since the fired dielectric constant depends on many variables encountered during the subsequent processing of an LTCC substrate. Currently, LTCC filters are typically being utilized in systems for applications that do not require precise filtering characteristics, such as image rejection filters or local oscillator signal filters. Furthermore, the filter bandwidth is normally designed to be much wider than the bandwidth of the signal of interest. Thus, even after the expected variation of the embedded filter, the signal will always fall within the pass band of the filter.

For narrow band applications where system requirements call for rejection very close to a specified pass band, a method for tuning the filters after firing is needed. One approach that has been proposed in the past is to place several filter designs that were purposely designed with offset center frequencies side by side on the same LTCC panel. Once the substrates are fired, the filters are tested and those that are closest to the desired center frequency are selected, while the rest are discarded. While this approach may be acceptable for some applications, there is a large yield penalty that increases the final cost of the filters. Another disadvantage is the large number of filter designs that would be required for a filter bank.

SUMMARY

Accordingly, it is an object of the present invention to provide a method of tuning the frequency response of a microwave filter.

It is another object of the invention to provide an improved method of tuning the frequency response of a microwave filter embedded in or formed on a ceramic substrate.

It is yet another object of the present invention to provide a method for accurately tuning the center frequency of an embedded LTCC filter.

These and other objects are achieved by a method of tuning the frequency response of filters embedded in or formed on a ceramic substrate, such as LTCC and/or HTCC, by re-firing a previously fired substrate to a temperature which is greater by a predetermined, relatively small, amount than that of the temperature used during the original firing profile of the substrate so as to change, for example, decrease the dielectric constant of the substrate, and thus cause a desired shift, for example, upward in the frequency response. In one aspect of the inventive method, a ridge waveguide bandpass filter embedded in a multi-layer LTCC substrate can be tuned to a higher center frequency by re-firing the substrate to a temperature above the initial firing temperature.

Further scope of applicability of the present invention will become apparent from the detailed description provided hereinafter. It should be understood, however, that the detailed description and specific examples while indicating the preferred embodiment of the invention, is provided by way of illustration only, since various changes and modifications within the spirit and scope of the invention will become apparent to those skilled in the art from the detailed description.

BRIEF DESCRIPTION OF THE DRAWINGS

The present inventive method will become more fully understood from the detailed description provided hereinafter, and the accompanying drawings, which are provided by way of illustration only, and thus are not meant to be limitative of the method, and wherein.

DETAILED DESCRIPTION OF THE INVENTION

Figure 1:
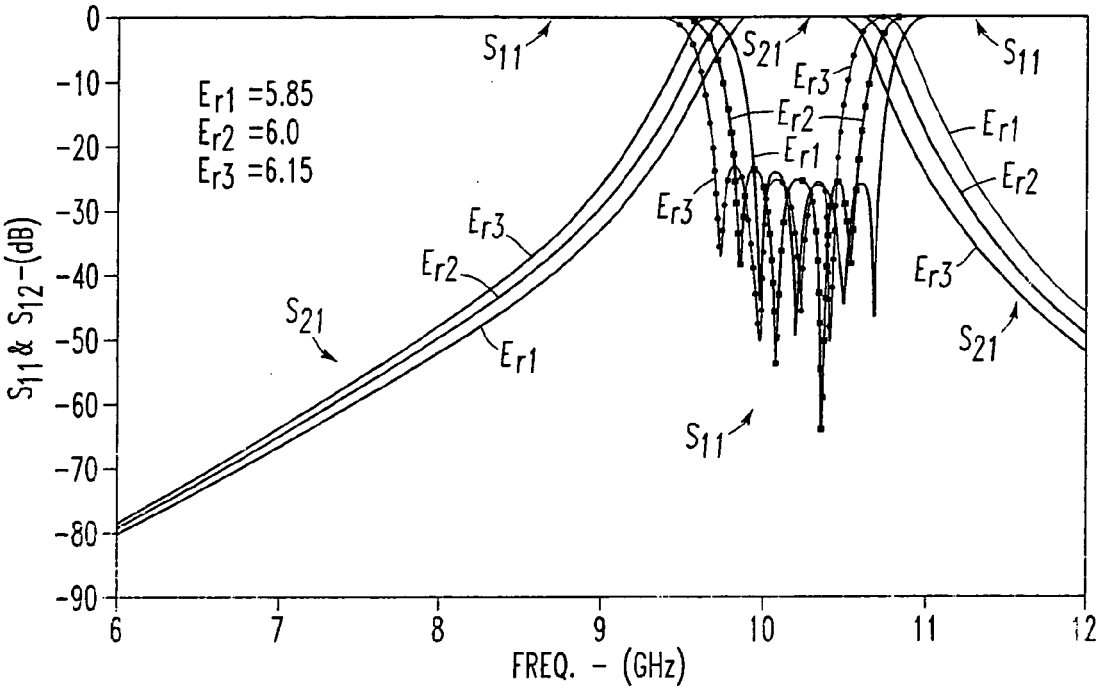
FIG. 1 is a set of characteristic curves illustrative of a simulated frequency response obtained from the same filter with varying dielectric constants.

Referring now to the remaining FIGS. 2–8, FIG. 2 is illustrative of a filter bank 10 including five discrete embedded ridge waveguide bandpass filters $\mathbf{12}_1$, $\mathbf{12}_2$, $\mathbf{12}_3$, $\mathbf{12}_4$, $\mathbf{12}_5$, for implementing five separate and distinct sub-bands, arranged side by side and embedded within a common LTCC substrate 14. Reference numeral 16 denotes a metallization pattern formed on the top surface of the substrate 14 for separating the five embedded filters $\mathbf{12}_1 \ldots \mathbf{12}_5$ and a bypass signal path 18. A stripline track 20 connects an input port p1 to one terminal 22 of a single pole six terminal (SP6T) switch 24. One of the other switch terminals connects to a stripline track at the top of the filterbank which serves as the signal by-pass path 18 with no inherent filtering. The remaining terminals of the switch 24 connect to stripline tracks $\mathbf{26}_1 \ldots \mathbf{26}_5$ which connect to respective input ports of the five filters $\mathbf{12}_1 \ldots \mathbf{12}_5$. The output ports of the filters $\mathbf{12}_1 \ldots \mathbf{12}_5$ connect to respective stripline tracks $\mathbf{28}_1 \ldots \mathbf{28}_5$ which connect to separate terminals of a second single pole six terminal switch 30 which has one terminal 32 connected to an output port p2 via a stripline track 34.

Figure 3:
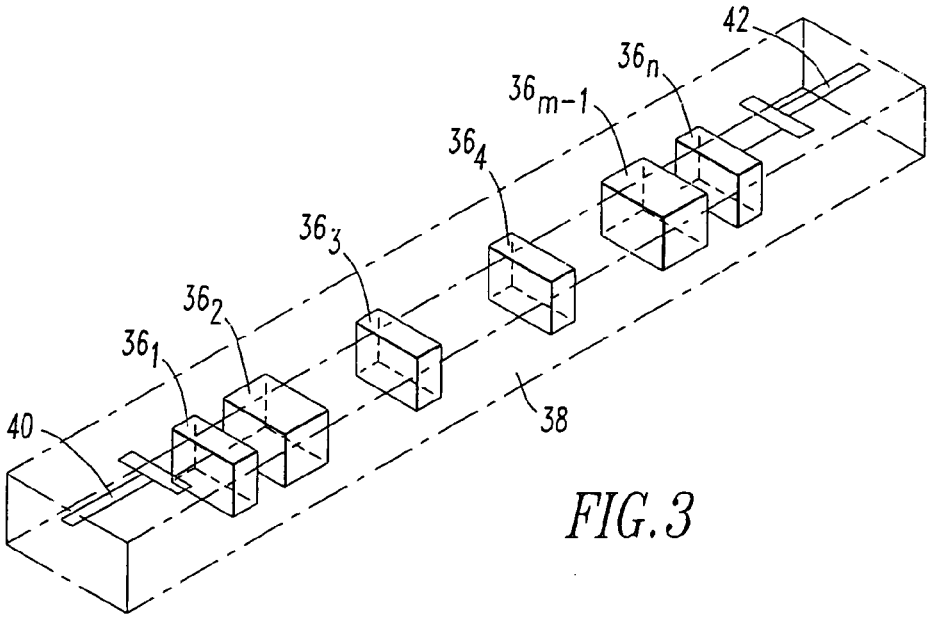
FIG. 3 is a perspective view further illustrative of a single embedded ridge waveguide filter of the type included in the filter bank shown in FIG. 2.
Figure 2:
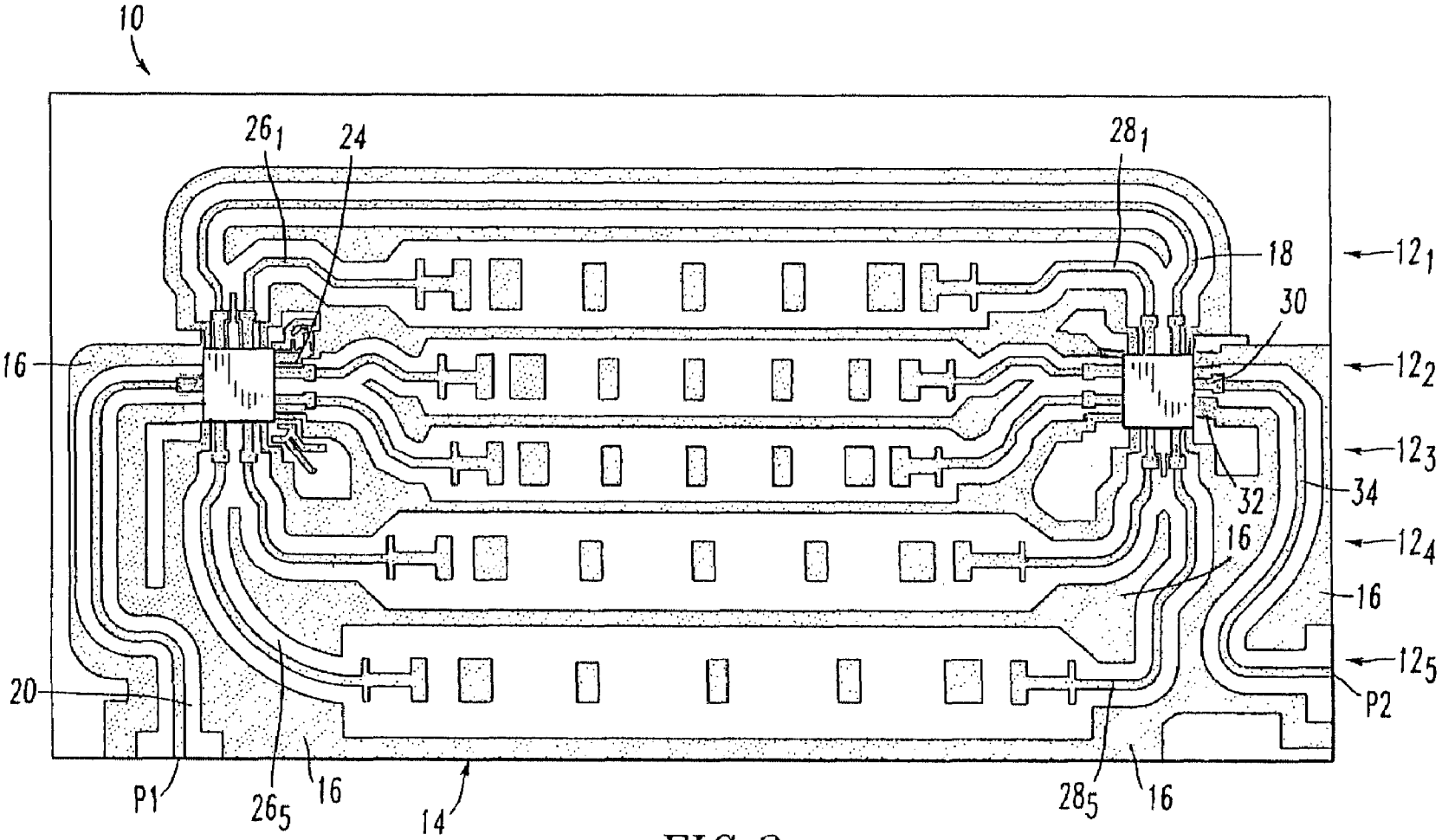
FIG. 2 is a top plan view of an embedded ridge waveguide filterbank including five individual ridge waveguide filters implemented in a multi-layer LTCC substrate.

FIG. 3 is illustrative of a single embedded ridge waveguide bandpass filter of the type included in the substrate 14 shown in FIG. 2. An embedded ridge waveguide structure is well known in the art and typically includes a plurality of ridged waveguide sections, for example, sections $\mathbf{36}_1 \ldots \mathbf{36}_n$ whose side walls are implemented with vias in a substrate formed of multiple layers of LTCC, and with the top and bottom walls of the waveguide sections being comprised of solid metal ground planes printed on the LTCC substrate. The ridge waveguide sections $\mathbf{36}_1 \ldots \mathbf{36}_n$ are appropriately spaced so as to provide an evanescent mode bandpass filter having a predetermined frequency response. Stripline circuits 40 and 42 are further provided at either end of the ridge waveguide sections $\mathbf{36}_1 \ldots \mathbf{36}_n$ for implementing an impedance match to circuitry, not shown, to which it is to be connected.

This invention is directed to a method of tuning the center frequency of filters embedded in dielectric material, such as LTCC, such as shown in FIGS. 2 and 3 by re-firing the previously fired (solid) LTCC substrate to a temperature which is above the temperature achieved during the original firing profile.

Typically, the ceramic in LTCC tape is a calcium borosilicate crystallizing glass ceramic. The sintering of this material occurs in two stages. Viscous sintering occurs first to form a dense ceramic followed by a crystallization of two main phases CaSiO3 and CaBxOy. The material is reported to remain consistent through refires at or below the original firing temperature. Heretofore, there was no apparent need for re-firing at temperature(s) above the original firing temperature following initial fabrication and therefore the effect of re-firing at elevated temperatures was of no concern. However, it was discovered by the subject inventors that when re-firing was performed at temperatures above the original firing temperatures, such a procedure would result in further crystallization of the glass ceramic, resulting in a change in dielectric constant and/or density, and as such could be utilized to selectively tune the center frequency of LTCC embedded filters.

Figure 4:
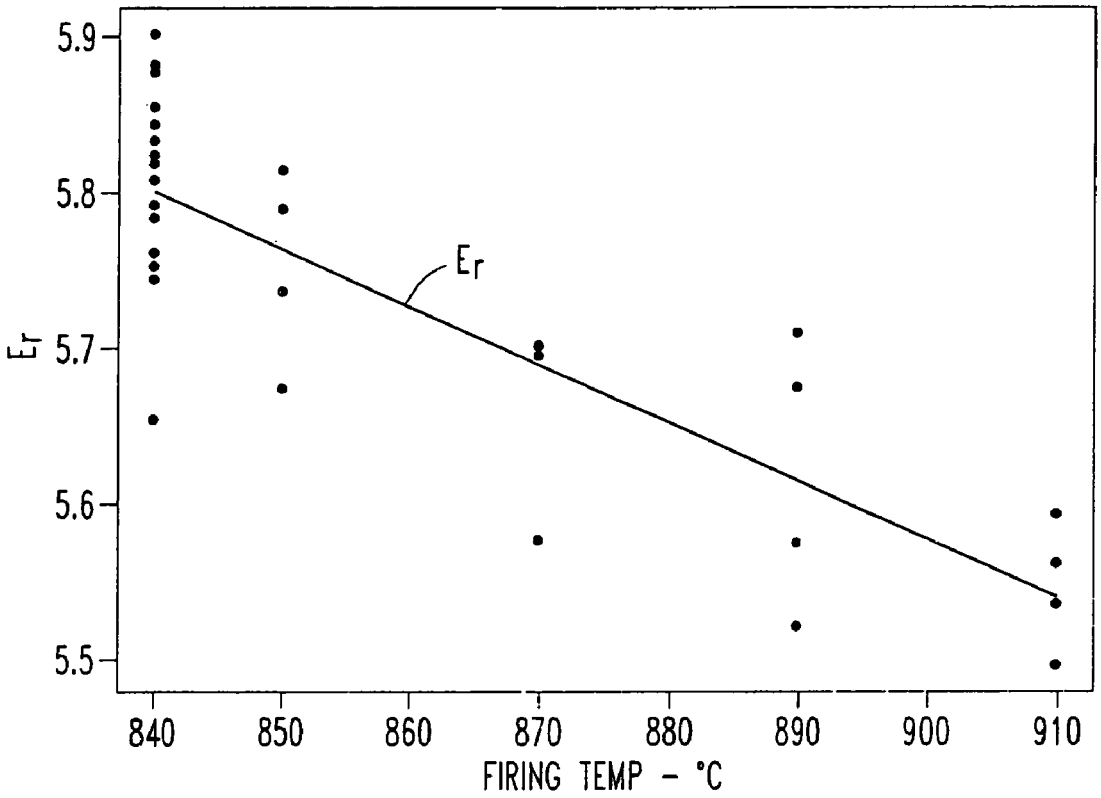
FIG. 4 is a plot illustrative of the relationship of dielectric constant as a function of re-firing temperature for a plurality of one particular type of LTCC substrates.

FIG. 4 is a graphical representation of a change in the value of the dielectric constant Er when at least four LTCC samples of Ferro A6 were refired from an original firing temperature of 840° C. It can be seen that re-firing at temperatures of 850, 870, 890 and 910° C. resulted in the lowering of the respective dielectric constant. It should be noted that these temperatures are specific to one type of LTCC material, i.e. Ferro A6 and are different for other types of LTCC and for HTCC. Furthermore, it was found that the change in dielectric constant is not dependent upon hold time, but only on the peak temperature achieved during the re-firing process.

FIGS. 5–8 are characteristic curves 44 and 46 illustrating measured S-parameters of an LTCC ridge waveguide bandpass filter before and after re-firing of an x-band filter embedded in an LTCC substrate. S-parameters are well known parameters used by microwave designers to quantify network responses and in this case, where there is a two port device, there are four S-parameters which are defined as follows: S12 is a measure of the response with voltage incident at port 2, while measuring the output voltage at port 1; S21 is a measure of the voltage incident into port 1 while measuring the output at port 2; S11 is the measure of the response with voltage incident at port 1 and the reflected voltage is measured at port 1; and, S22 is a response of the response with voltage incident at port 2 and the reflected voltage is also measured at port 2.

Figure 5:
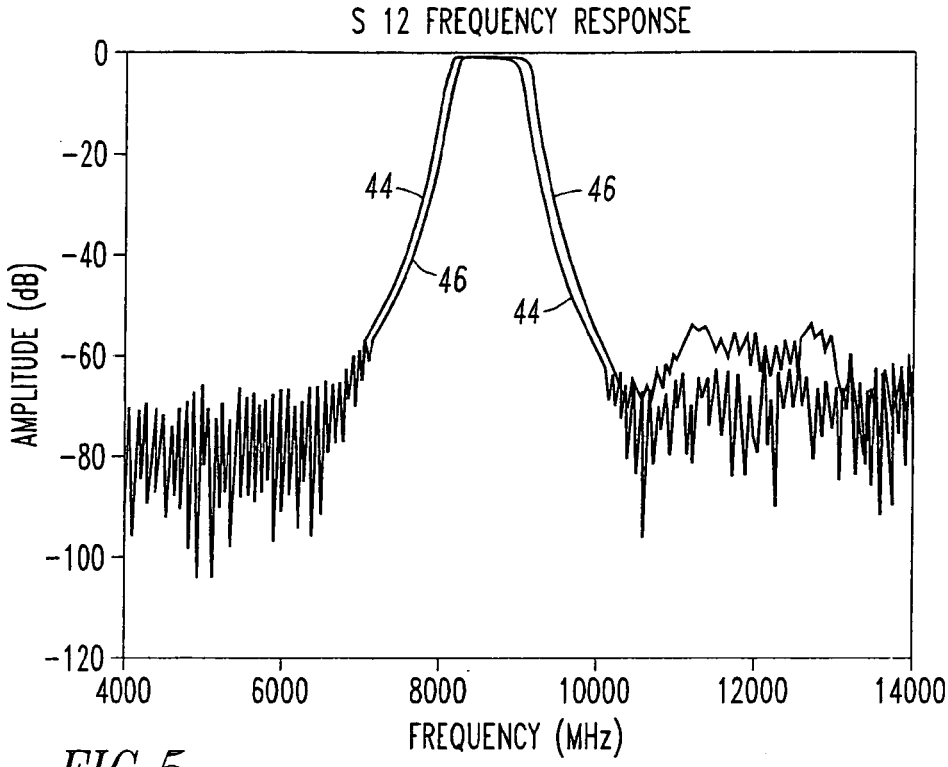
FIGS. 5–8 depict the measured S-parameters of an embedded filter of the type shown in FIG. 3 tuned to a different center frequency by re-firing the LTCC substrate with different peak profile temperatures as shown in FIG. 4.
Figure 6:
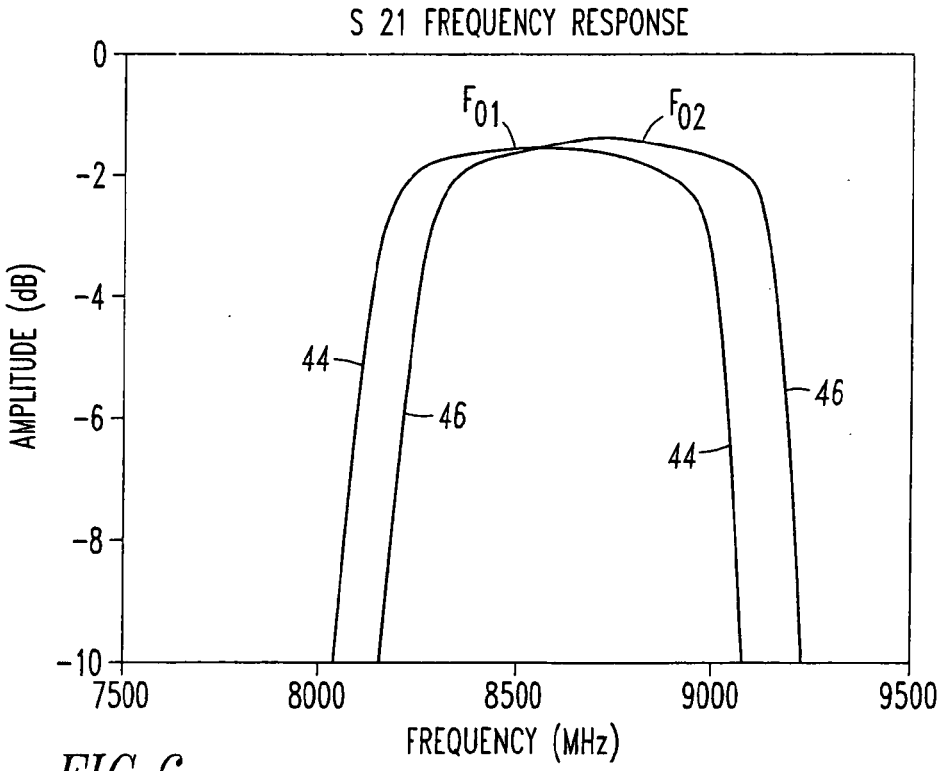
Figure 7:
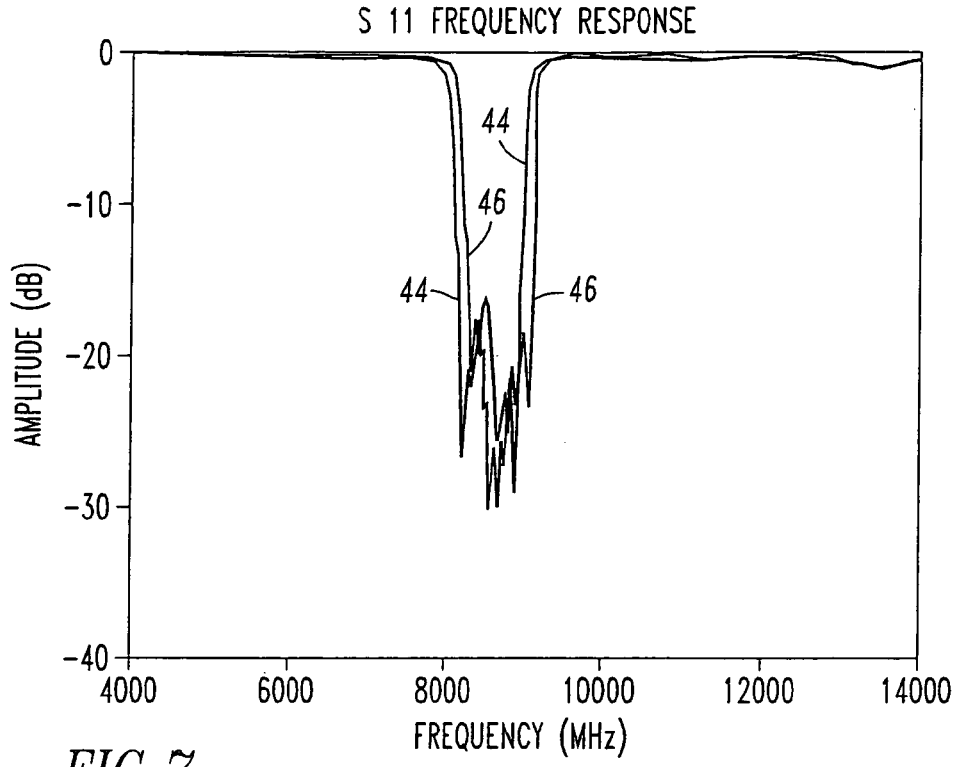
Figure 8:
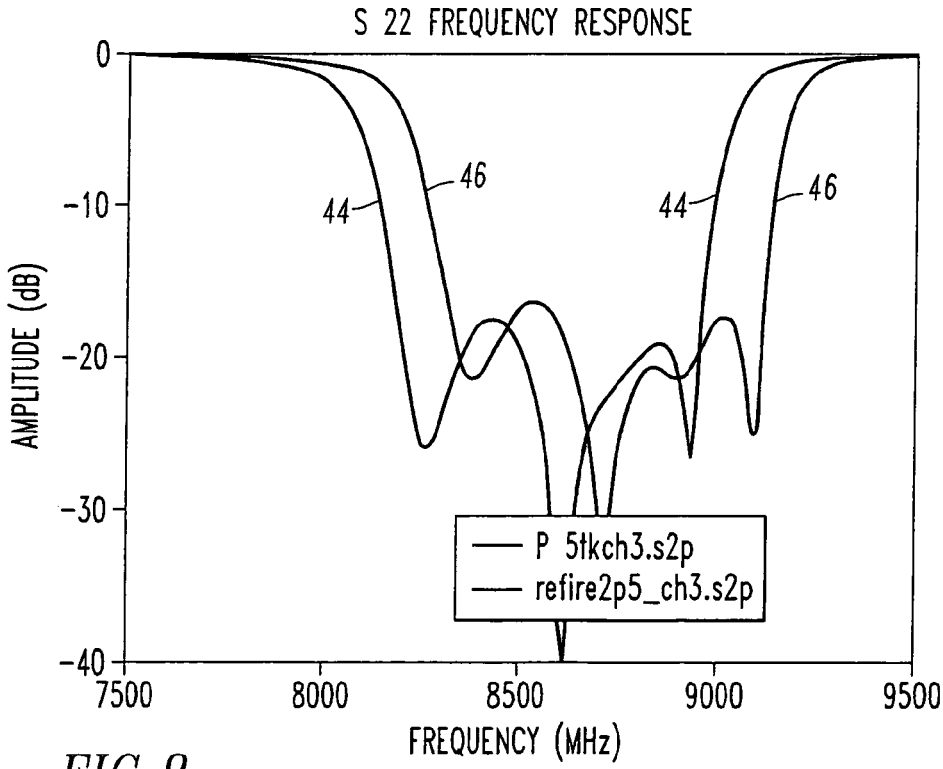

FIG. 5 is illustrative of the S12 frequency response, FIG. 6 depicts the S21 frequency response, FIG. 7 depicts the S11 frequency response and FIG. 8 depicts the S22 frequency response of the same bandpass filter.

The measured center frequency $F_{o1}$ following a first firing is shown to be about 8566 MHz. This is shown clearly in the S21 frequency response of FIG. 6. When the substrate containing the filter was refired at 900° C., the center of frequency $F_{o2}$ was measured again after cooling and found to be about 8703 MHz, indicating that the re-firing process caused a shift of the center of frequency of the filter up by approximately 136 MHz.

In addition to the filter whose characteristics are shown in FIGS. 5–8, four other filters embedded in the same LTCC substrate as shown, for example, in FIG. 2 were subjected to re-firing. Table 1 below summarizes the data measured from the same five filter configurations. In Table 1, the column "Filename" merely indicates an assigned name for each of the filters for the initial firing and the re-firing, along with the measured change (deltas). The adjacent column "IL,min" is the minimum S21 insertion loss in the pass band of the filter. The column "Fo, MHz" is the center frequency.

The next column "BW, 3 dB" is the bandwidth measured at 3 dB down from IL,min and the column "fl, 3 dB", is the frequency on the low side of the pass band, where S21 is 3 dB down from IL, min. The column "fh, 3 dB", is the frequency on the high side of the pass band where S21 is 3 dB down from IL, min.

Next, the column "BW, 20 dB" is the bandwidth of the filter measured from the 20 dB points. The column "fl, 20 dB" corresponds to the frequency on the low side of the pass band where S21 is 20 dB down from IL, min, and, "fh, 20 dB" is the frequency on the high side of the pass band where S21 is 20 dB down from IL, min.

It should be noted that the measured S21 data of the third filter design identified by the file name P5tkch3.s2p corresponds to the characteristic curves shown in FIGS. 5–8. In all instances, the center frequency $F_o$ shifted upward upon re-firing as shown by the positive deltas in the "$F_o$, MHz" column of Table 1. In all instances, the insertion loss also improved upon re-firing as shown by the positive deltas in the "IL, min" column in Table 1.

TABLE 1

| Filename | IL, min | Fo, MHz | BW, 3 dB | fl, 3 dB | fh, 3 dB | BW, 20 dB | fl, 20 dB | fh, 20 dB |
|---|---|---|---|---|---|---|---|---|
| P5tkch1.s2p | −1.3 | 7327.1 | 881.6 | 6886.3 | 7767.8 | 1286.9 | 6670.3 | 7957.2 |
| refire2p5_ch1.s2p | −1.2 | 7435.3 | 901.4 | 6984.6 | 7886.1 | 1302.4 | 6770.4 | 8072.8 |
| Deltas | 0.1 | 108.2 | 19.8 | 98.3 | 118.3 | 15.5 | 100.1 | 115.6 |
| P5tkch2.s2p | −1.4 | 7941.6 | 887.6 | 7497.8 | 8385.5 | 1274.5 | 7305.6 | 8580.1 |
| refire2p5_ch2.s2p | −1.3 | 8067.9 | 907.9 | 7613.9 | 8521.8 | 1289 | 7423.3 | 8712.2 |
| Deltas | 0.1 | 126.3 | 20.3 | 116.1 | 136.3 | 14.5 | 117.7 | 132.1 |
| P5tkch3.s2p | −1.6 | 8566.3 | 893.7 | 8119.5 | 9013.2 | 1306.2 | 7899.5 | 9205.7 |
| refire2p5_ch3.s2p | −1.4 | 8702.6 | 917.1 | 8244.1 | 9161.2 | 1318.9 | 8027.9 | 9346.8 |
| Deltas | 0.2 | 136.3 | 23.4 | 124.6 | 148 | 12.7 | 128.4 | 141.1 |
| P5tkch4.s2p | −2.2 | 8998.6 | 697.8 | 8649.7 | 9347.5 | 1111.9 | 8484.8 | 9596.7 |
| refire2p5_ch4.s2p | −2.1 | 9135.9 | 701.1 | 8785.4 | 9486.5 | 1138.2 | 8620.7 | 9759 |
| Deltas | 0.1 | 137.3 | 3.3 | 135.7 | 139 | 26.3 | 135.9 | 162.3 |
| P5tkch5.s2p | −3.6 | 9689 | 186.1 | 9596 | 9782 | 1076.2 | 9242.2 | 10318.4 |
| refire2p5_ch5.s2p | −3.2 | 9837.4 | 179 | 9747.9 | 9926.9 | 1077.3 | 9397 | 10474.4 |
| Deltas | 0.4 | 148.4 | −7.1 | 151.9 | 144.9 | 1.1 | 154.8 | 156 |

Thus what has been shown is a method of shifting the center frequency of a microwave filter embedded in a multi-layer ceramic substrate, such as LTCC, by re-firing the substrate containing the filter to a higher temperature following initial fabrication. It should be noted that this method is not limited to filters embedded in LTCC, but also applicable to HTCC filters. It is also applicable to any stripline filters embedded in a multilayer ceramic substrate as well as microstrip filter structures printed on a single layer of ceramic substrate. This method is further applicable to high pass or low pass filters wherein tuning comprises tuning the cutoff frequency of the filter.

The inventive method being thus described, it will be obvious that it may be varied in a variety of ways. Such variations, however, are not to be regarded as a departure from the spirit and scope of the invention. Accordingly, and all such modifications as would be obvious to one skilled in the art are intended to be included within the scope of the following claims.

The invention claimed is:

1. A method of changing the frequency response of a microwave filter fabricated in connection with a substrate of ceramic material, comprising:

re-firing the substrate at a second temperature higher than the initial firing temperature so as to cause a change in the dielectric constant of the ceramic material, thereby changing the frequency response of said filter.

2. The method of claim 1 wherein changing the frequency response comprises tuning the frequency response of a filter embedded in a substrate of co-fired ceramic type.

3. The method of claim 2 wherein the co-fired ceramic tape comprises low temperature co-fired ceramic (LTCC).

4. The method of claim 2 wherein the co-fired ceramic tape comprises high temperature co-fired ceramic tape (HTCC).

5. The method of claim 2 wherein the filter comprises a filter embedded in a multilayer ceramic substrate.

6. The method of claim 5 wherein the filter comprises a bandpass or band reject filter and wherein tuning comprises tuning the center frequency of the filter.

7. The method of claim 6 wherein the filter comprises a waveguide type filter structure.

8. The method of claim 2 wherein the filter comprises a high pass or low pass filter and wherein tuning comprises tuning the cutoff frequency of the filter.

9. The method of claim 2 wherein the filter comprises a stripline filter structure embedded in a multilayer substrate of ceramic material.

10. The method of claim 2 wherein the filter comprises a microstrip filter structure formed on a single layer ceramic substrate.

11. The method of claim 2 wherein the filter comprises a bandpass or band reject filter embedded in or formed on a ceramic substrate, and wherein the step of re-firing the substrate from said initial firing temperature to said second temperature causes the dielectric constant of the ceramic substrate to decrease in value and thereby shift center frequency of the filter upward.

12. The method of claim 2 wherein the filter comprises a high pass filter or low pass filter embedded in or formed on a ceramic substrate, and wherein the step of re-firing the substrate from said initial firing temperature to said second temperature causes the dielectric constant to decrease in value and thereby shift the cutoff frequency of the filter upward.

* * * * *